United States Patent [19]

Grace et al.

[11] 4,422,953

[45] Dec. 27, 1983

[54] CORROSION INHIBITION OF HALOCARBON SYSTEMS

[75] Inventors: Mark T. Grace; Michael I. Naiman, both of St. Louis; Eddie C. French, Manchester, all of Mo.

[73] Assignee: Petrolite Corporation, St. Louis, Mo.

[21] Appl. No.: 370,330

[22] Filed: Apr. 21, 1982

[51] Int. Cl.[3] ..... C23F 11/12; C23F 11/14; C23F 11/16

[52] U.S. Cl. ..... 252/392; 106/14.27; 106/14.31; 106/14.41; 106/14.42; 106/14.43; 203/7; 208/47; 252/395; 252/396; 252/389 R

[58] Field of Search ..... 252/391, 389.62, 392, 252/396, 395

[56] References Cited

U.S. PATENT DOCUMENTS

| | | | |
|---|---|---|---|
| 3,090,753 | 5/1963 | Matuszak et al. | 252/396 |
| 3,762,873 | 10/1973 | Oudealink | 252/392 |
| 4,253,876 | 3/1981 | Godav et al. | 252/392 |

*Primary Examiner*—Irwin Gluck

*Attorney, Agent, or Firm*—Sidney B. Ring

[57] ABSTRACT

This invention relates to a method of inhibiting corrosion in halohydrocarbon systems such as haloethylene or other corrosive systems, which comprises treating such system with alkyl, alkenyl, or alkyl-X succinic acids or derivatives thereof, for example, salts thereof, where X is an oxygen, sulfur, amino, etc. containing group.

10 Claims, No Drawings

CORROSION INHIBITION OF HALOCARBON SYSTEMS

This invention relates to the inhibition of corrosion in halocarbon systems.

Certain compositions, including halocarbons, for example, chlorohydrocarbons such as ethylene dichloride, chloroethane, carbon tetrachloride, etc., mixtures thereof, etc., are corrosive particularly in the presence of water at elevated temperatures such as in distillation column overheads.

Oxygen, acid, water and other impurities are carried in halocarbon mixtures and often cause extensive corrosion to take place on metal surfaces of distillation columns, pipelines, collecting vessels, heat exchangers, and the like.

Heretofore, corrosion caused by such halocarbon systems has been treated with limited success by the following techniques:

I. Very costly replacement of the severely corroded equipment with exotic materials such as various nickel alloys.

II. A partial treatment comprising the neutralization of produced hydrochloric acid with caustic, amines or other basic materials with very limited success.

III. Certain inhibitor systems have been tested experimentally. However, large scale use of these inhibitors has produced questionable results. Most inhibitor systems have relied totally on the neutralization of acid produced. The following are illustrative:

(1) U.S. Pat. No. 3,801,659

(2) K. W. Calkins, "Corrosion Inhibition for Carbon Tetrachloride", *Corrosion* September, 1959

(3) Inder Singh, "Corrosion of Metals in Chlorohydrocarbon Solvents". *Chemical Concepts* August, 1977.

Plants used in the production of chlorohydrocarbon such as ethylene dichloride are well known. Some of these are described in the following publications:

(1) U.S. Pat. No. 4,042,640

(2) U.S. Pat. No. 3,941,868

(3) U.S. Pat. No. 3,801,660

Although the feedstocks in these plants may be different, the final products are various mixtures of chlorohydrocarbons that must be purified by distillation.

We have now discovered a process of inhibiting corrosion in such halohydrocarbon systems, for example chlorhydrocarbon systems, such as an ethylene dichloride, chloroethane systems, etc., which comprises treating such systems with an alkyl, alkenyl, or alkyl-X succinic acid or salts thereof, where the alkyl-X group represents X as S, O, amino, etc., formed by reacting thiols, alcohols, amines, etc. with maleic anhydride and the like, examples of which are:

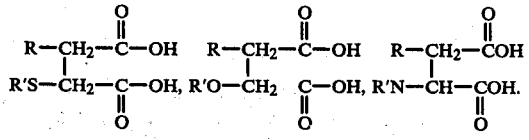

This invention prevents corrosion of metal parts in these plants by the addition of an alkyl, alkenyl, or alkyl-X-succinic anhydride, acid or salt in appropriate concentration based on either water content or hydrocarbon content. The anhydride and acid forms are added to the chlorohydrocarbons while the salt form is added to the water. The particular point of addition, type of inhibitor such as chlorocarbon soluble or water soluble and concentrations thereof will depend largely on such variables as the design of the particular plant, the place of severe corrosion, the personal preference of the operator, etc.

Any suitable alkenyl, alkyl, and alkyl-X succinic anhydride or the corresponding acid or salts thereof are utilizable in the present invention. The general structural formulae of these compounds are:

Anhydride

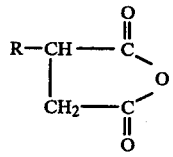

Acid

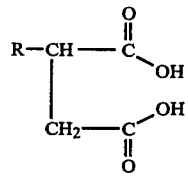

Salts

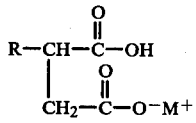

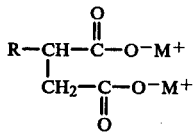

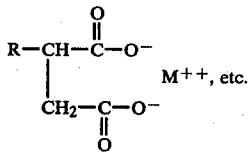

where M is a cation and wherein R is an alkyl, alkenyl or alkyl-X group which is derived from any substituent that adds to the maleic anhydride double bond such as and not limited to an alkene, alkoxide, mercaptan, alkylamine, etc.

The alkenyl group, as well as the aforementioned substituents, can be straight chain or branched chain; and they can be saturated at the point of unsaturation by the addition of a substance which adds to olefinic double bonds, such as hydrogen, sulfur, bromine, chlorine, or iodine. It is obvious of course, that there must be at least two carbon atoms in the alkenyl or aforementioned groups, but there is no real upper limit to the number of carbon atoms therein. However, it is preferable to use an alkenyl or substituent group having between about 4 and about 18 carbon atoms. The alkenyl succinic anhydrides, acids or salts and the aforementioned substituted succinic anhydrides, acids or salts are interchangeable for the purposes of the present invention. Accordingly, when the term "alkenyl" succinic anhydride, acid or salt is used herein, it must be clearly understood that it embraces the substituted acids as well as the derivatives thereof in which the olefinic double bond has been saturated to form the alkyl group as set forth hereinbefore (generally referred to as ASA). Non-limiting examples of the ASA are ethenyl succinic anhydrides; ethenyl succinic acid; ethyl succinic anhydride; ethyl thio succinic acids; propenyl succinic anhydride; sulfurized propenyl succinic anhydride; butenyl succinic acid; 2-methyl-butenyl succinic anhydride; 1,2-dichloropentyl succinic anhydride; hexenyl succinic anhydride; hexyl succinic acid; sulfurized 3-methylpentenyl succinic anhydride; 2,3-dimethylbutenyl succinic anhydride; 3,3-dimethylbutenyl succinic acid; 1,2-dibromo-2-ethylbutyl succinic acid; heptenyl succinic anhydride; 1,2-diodooctyl succinic acid; octenyl succinic anhydride; 2-methylheptenyl succinic anhydride; 4-ethylhexenyl succinic acid; octylthio succinic acid, 2-isopropylpentyl succinic anhydride; nonenyl succinic anhydride; 2-propylhexenyl succinic anhydride; decenyl succinic acid; decenyl succinic anhydride; 5-methyl-2-isopropylhexenyl succinic anhydride; 1,2-dibromo-2-ethyloctenyl succinic anhydride; decyl succinic anhydride; undecenyl succinic anhydride; 1,2-dichloroundecyl succinic acid; 3-ethyl-2-t-butylpentenyl succinic anhydride; dodecenyl succinic anhydride; dodecenyl succinic acid; 2-propylnonenyl succinic anhydride; 3-butyloctenyl succinic anhydride; tridecenyl succinic anhydride; tetradecenyl succinic anhydride; hexadecenyl succinic anhydride; sulfurized octadecenyl succinic acid; octadecyl succinic anhydride; 1,2-dibromo-2-methylpentadecenyl succinic anhydride; 8-propylpentadecyl succinic anhydride; eicosenyl succinic anhydride; 1,2-dichloro-2-methylnonadecenyl succinic anhydride; 2-octyldodecenyl succinic acid; 1,2-diiodotetracosenyl succinic anhydride; hexacosenyl succinic acid, hexacosenyl succinic anhydride; and hentriacontenyl succinic anhydride.

The methods are well known to those familiar with the art. The methods are typical of those that add a substance such as an alkenyl group to the maleic anhydride double bond. In order to produce the reaction products of this invention, maleic anhydride must be used. Succinic anhydride and succinic acid are not utilizable herein. For example, the reaction product produced by reacting the substituent with succinic anhydride is unsatisfactory. As a non-limiting example the reaction of an olefin with maleic anhydride is feasible. Corresponding substituted succinic anhydrides, acids or salts such as alkyl thio succinic acid can also be employed; the preparation of these substituted succinic anhydrides, acids or salts is well known to the art.

Corresponding substituted succinic anhydrides, acids and salts such as alkyl, alkenyl, or alkyl-X succinic-anhydride or mixtures thereof, can also be employed. Such mixtures, as well as relating pure substituted anhydrides, are utilizable herein.

In practice, about 10 to 10,000 ppm of ASA, such as from about 20 to 5,000 ppm, for example from about 30 to 3,000 ppm, but preferably from about 50 to 1,000 ppm can be employed based on the weight of chlorohydrocarbon employed in the process. Further, similar concentrations of ASA are employed when concentrations are based on the weight of the water involved in the plant process. Addition can be made into the feedstock, in the overhead, in the distillation tower, etc. or at more than one point, etc.

The following examples are presented for purposes of illustration and not of limitation. The following feedstocks were used in the examples.

| Compounds | % Volume |
|---|---|
| Feedstock I | |
| ethylene dichloride | 34.2 |
| carbon tetrachloride | 34.2 |
| chloroform | 17.2 |
| chlorothane | 10 |
| others | 4.4 |
| Feedstock II | |
| chloroethane | 40 |
| carbon tetrachloride | 26.9 |
| chloroform | 15.4 |
| ethylene dichloride | 8.7 |
| others | 9 |

These feedstocks are not limiting; other mixtures of chlorocarbons can also be used.

The present invention was tested under the following conditions where $$PP = \frac{BR - IR}{BR} \times 100$$

when

PP = percent protection
BR = Blank uninhibited rate
IR = Inhibited rate.

Test Series A

The rest apparatus is a glass lined, stainless steel autoclave that contains a test fluid of 300 ml of Feedstock I and 4000 ppm deionized water. The test duration is twenty-four hours, the temperature is 175° F.±2° F., and the agitation rate creates sufficient mixing of water+halocarbons. Specimens are 1018 steel cut into a cylinder with dimensions $\frac{1}{4}'' \times 1\frac{3}{4}''$. The specimens are polished by sand blasting and cleaned with trichloroethylene and acetone. Corrosion data is based on the average weight loss of three specimens. The results are presented in Table I.

TABLE I (Corrosion Rate Without Inhibitor: 135 mpy)

| Example | Inhibitor | Concentration (ppm) | % Protection |
|---|---|---|---|
| 1 | decenyl succinic acid | 100 | 88 |
| 2 | octenyl succinic acid | 100 | 92 |
| 3 | tetrapropylene succinic acid | 500 | 77 |
| 4 | tetrapropylene succinic acid | 100 | 87 |
| 5 | tetrapropylene succinic acid | 50 | 46 |
| 6 | tetrapropylene succinic acid | 25 | 60 |
| 7 | tetrapropylene succinic acid | 10 | 47 |

Test Series B

Further tests were carried out with the test fluid being changed to 78.6 percent by volume deionized water and 21.4 percent by volume Feedstock I. The test apparatus and specimens used here are identical to the above mentioned procedure of Test Series A. Corrosion monitoring in these cases used the Petrolite® M4100 Potentiodyne. The corrosion measurements were recorded during the sixth hour of the test. In all cases, the pH of the water was adjusted to the 6–9 range with the addition of ethylene diamine. The results are presented in Table II.

TABLE II

| Example | Inhibitor | Concentration (ppm) | % Protection |
|---|---|---|---|
| | (Corrosion Rate Without Inhibitors: 260 mpy) | | |
| 8 | n-octylthio succinic acid* | 655 | 95 |
| 9 | n-octylthio succinic acid* | 200 | 84 |
| 10 | n-butylthio succinic acid** | 200 | 96 |
| 11 | n-octylthio methylenethio succinic acid*** | 200 | 94 |
| 12 | maleic acid | 200 | 1 |
| 13 | succinic acid | 200 | 35 |
| 14 | n-decenyl succinic acid | 200 | 93 |
| 15 | n-octenyl succinic acid | 200 | 82 |

*R = n-octyl S—
**R = n-butyl S—
***R = n-octyl S—$CH_2S$—

Test Series C—Field Tests

This invention was also tested in the field with sidestream studies on an ethylene dichloride purification unit. The conditions were as follows:

Process water from the ethylene dichloride purification unit overhead was circulated through three Plexiglass® cells. Each cell holds three specimens of 1018 steel cut into a cylinder with dimensions $\frac{1}{4}'' \times 1\frac{3}{4}''$. Measurements of the process water pH throughout the experiments indicated a range of 6 to 7.5. The corrosion rate was recorded each half hour by the Petrolite® M-4100 Potentiodyne. The inhibitors were added to the first cell and corrosion measurements were obtained from each cell. The results of these sidestream studies are presented in Table III.

TABLE III

| Example | Inhibitor | Concentration (ppm) | % Protection |
|---|---|---|---|
| | (Corrosion Rate Without Inhibitor: 140 mpy) | | |
| 16 | n-hexenyl succinic acid-salt (sodium salt) | 500 | 94 |
| 17 | n-octenyl succinic acid-salt (sodium salt) | 500 | 99 |
| 18 | n-octenyl succinic acid-salt (sodium salt) | 200 | 95 |
| 19 | n-octenyl succinic acid salt (sodium salt) | 100 | 67 |
| 20 | n-decenyl succinic acid salt (sodium salt) | 500 | 99 |
| 21 | n-dodecenyl succinic salt (sodium salt) | 500 | 98 |
| 22 | n-butylthio succinic acid salt (sodium salt) | 500 | 74 |
| 23 | n-butylthio succinic acid salt (ammonia salt) | 500 | 90 |
| 24 | n-octenyl succinic acid | 500 | 99 |

TABLE III-continued

| Example | Inhibitor | Concentration (ppm) | % Protection |
|---|---|---|---|
| | (Corrosion Rate Without Inhibitor: 140 mpy) | | |
| 25 | tetrapropylene succinic acid | 500 | 92 |

Test Series D n-octenyl succinic acid salt (sodium salt) was continuously injected at 200 ppm into an ethylene dichloride purification unit overhead. The injection rate is based on the amount of water present. The addition of this compound reduced the corrosion rate from 90 mpy to 4 mpy as measured by a Model 212 Petrolite® Corrosion Rate Meter; corrosion protection of approximately 96 percent.

We claim:

1. A process of inhibiting the corrosion of a halocarbon system which comprises treating the system with an alkyl, alkenyl, or alkyl-X succinic acid or a salt thereof, where X is an oxygen, sulfur, or amino containing group.

2. The process of claim 1 where the alkyl, alkenyl, or alkyl-X group has at least about 4 carbons.

3. The process of claim 2 where the alkyl, alkenyl, or alkyl-X group has from about 4–18 carbons.

4. A composition comprising a halocarbon and a corrosion inhibiting amount of an alkyl, alkenyl, or alkyl-X succinic acid or salt thereof where X is an oxygen, sulfur, or amino containing group.

5. The composition of claim 4 where the alkyl, alkenyl, or alkyl-X group has at least about 4 carbons.

6. The composition of claim 5 where the alkyl, alkenyl, Alkyl-X group has from about 4 to 18 carbons.

7. The process of claim 1 where X is sulfur.

8. The composition of claim 4 where X is sulfur.

9. The process of claim 7 where the compositions employed are as follows:

octenyl succinic acid
decenyl succinic acid
tetrapropenyl succinic acid
butylthio succinic acid
octylthio succinic acid
hexenyl succinic acid
dodecenyl succinic acid
octylthiomethylenethio succinic acid and mixtures thereof.

10. The composition of claim 8 where the compositions are:

octenyl succinic acid
decenyl succinic acid
tetrapropenyl succinic acid
butylthio succinic acid
octylthio succinic acid
hexenyl succinic acid
dodecenyl succinic acid
octylthiomethylenethio succinic acid and mixtures thereof.

* * * * *